United States Patent [19]

Ibarra

[11] Patent Number: 4,699,057

[45] Date of Patent: Oct. 13, 1987

[54] MORTAR SHELL TIME FUSE

[75] Inventor: Inigo A. Ibarra, Vizcaya, Spain

[73] Assignee: Esperanza y Cia., S.A., Spain

[21] Appl. No.: 849,816

[22] Filed: Apr. 9, 1986

[30] Foreign Application Priority Data

Mar. 24, 1986 [ES] Spain ..... 293155

[51] Int. Cl.[4] ..... F42C 1/08; F42C 15/04; F42C 9/14

[52] U.S. Cl. ..... 102/248; 102/255; 102/270

[58] Field of Search ..... 102/270, 271, 247–249, 102/251, 254–256, 258, 260

[56] References Cited

U.S. PATENT DOCUMENTS

| | | | |
|---|---|---|---|
| 2,977,882 | 4/1961 | Jasse | 102/248 |
| 3,115,094 | 12/1963 | Simmen | 102/255 |
| 3,148,621 | 9/1964 | Varaud | 102/270 X |
| 3,345,947 | 10/1967 | Combourieux | 102/270 X |
| 3,380,384 | 4/1968 | Kaiser et al. | 102/270 X |
| 3,495,533 | 2/1970 | Müller | 102/248 |
| 3,715,987 | 2/1973 | Morel et al. | 102/248 |

*Primary Examiner*—David H. Brown
*Attorney, Agent, or Firm*—Lucas & Just

[57] ABSTRACT

A mortar shell time fuse of the type which consists of a body and a head, and characterized because it is comprised of:

(a) a secondary mass floating upon a return spring in a hole in the body;

(b) means for holding the secondary mass at rest;

(c) a gear train subjected to the action of a torsion spring and linked at rest with the secondary mass, and comprised of:

($c_1$) means of retarding its rotation.

($c_2$) means for the restraining and releasing of:

(d) a shell holder with a rotation shaft subject to the action of a torsion spring.

10 Claims, 4 Drawing Figures

MORTAR SHELL TIME FUSE

This invention is concerned with a time fuse for mortar shells of the type that consists of a body and a head which is characterized because it is comprised of:

(a) a secondary mass floating upon a return spring in a hole in the body;

(b) means for holding the secondary mass at rest;

(c) a gear train subjected to the action of a torsion spring and linked at rest with the secondary mass, and comprised of:

($c_1$) means of retarding its rotation.

($c_2$) means for the restraining and releasing of:

(d) a shell holder with a rotation shaft subject to the action of a torsion spring.

It is also characterized because the means for holding the secondary mass at rest are comprised of:

(a) a primary mass, subjected to the action of a return spring, and which consists of a head in the form of a needle, and a body that slides on the inside of:

(d) a shell holder with a rotation shaft subject to the action of a torsion spring.

It is also characterized because the means for holding the secondary mass at rest are comprised of:

(a) a primary mass, subjected to the action of a return spring, and which consists of a head in the form of a needle, and a body that slides on the inside of:

(b) a fixed sleeve, upon whose outside slides the secondary mass, and possessing an upper hole through which the head of the primary mass may protrude, and a side window;

(c) a ball enclosed between the top of the primary mass body, the sleeve window, and an inside slot in the secondary mass.

It is also characterized because the secondary mass comprises externally a groove with a flexible expansion ring which is released once the secondary mass has travelled along a predetermined distance inside a sleeve located within the hole in the body.

It is also characterized because the secondary mass comprises a throat into which an externally operated pin is inserted.

It is also characterized because the gear train is comprised of:

(a) a main gearwheel with a recess in the form of a circular sector on its lower face wherein the top of the secondary mass enters when at rest;

(b) a bottom pinion which meshes with the main gearwheel;

(c) a top pinion which is coaxially attached to the bottom pinion.

It is also characterized because the timing means comprises a rocker that is coaxial with the main gearwheel and is driven by the top pinion.

It is also characterized because the means for restraining and releasing the shell holder are such that said shell holder is a cylinder, where the distance between the axis of its rotation and the main gearwheel axis is less than the sum of the radii of the main gearwheel shell holder, and where, there are on both, a number of circular section recesses, and where when at rest, the non-recessed area of one of the parts lies opposite the recessed area on the other.

It is also characterized because the shell holder possesses two ports from base to base located upon the circumference, the radius of which is the distance between the shell holder axis and the firing pin axis.

It is also characterized because a bevel headed screw arranged for operation at will from the outside is provided in order, if necessary, to abut or not against a first pin in the shell holder, so as to impose a limitation as to its turning angle in such a way that one of the shell holder ports lies opposite the firing pin hole.

It is also characterized because upon the shell holder there is a second pin which abuts against the main gearwheel during rotation of the shell holder, and imposes a limitation as to its turning angle in such a way that one of the shell holder ports lies opposite the firing pin hole.

It is also characterized because the bevel headed screw is provided with a slot into which may be placed a keeper to restrict its angle of rotation.

Figure 1:
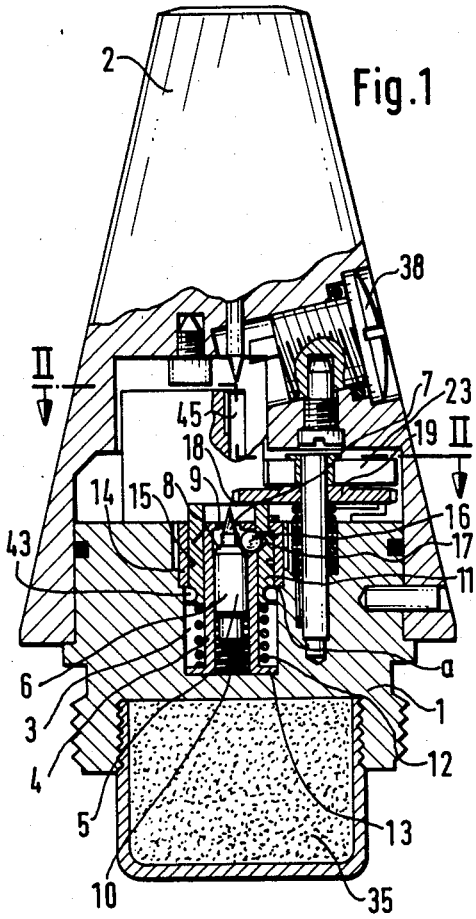
FIG. 1 is a section view in elevation of the time fuse in the idle position.
Figure 3:
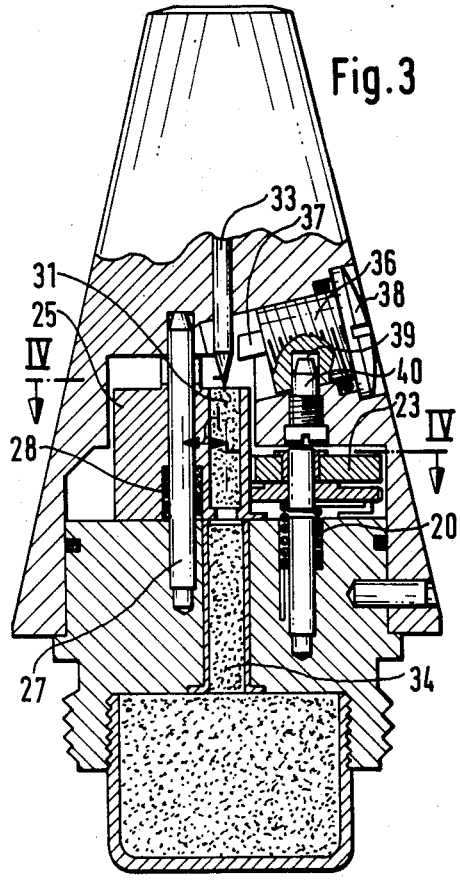
FIG. 3 is a section view in elevation of the time fuse in the firing position.

The time fuse consists of a body (1) that is screwed onto a head (2).

In said body (1), there is a cylindrical hollow (3) and inside same is fitted a sleeve (4) in whose interior can slide a primary mass (5) with its body (6) and head (7) in the shape of a needle, and there is a truncated cone shaped joining area (8) between the body (6) and head (7), where this latter is able to protrude through a hole (9) in the sleeve (4).

The primary mass (5) is subjected to the action of a spring (10).

Over the outside of the inside sleeve (4) may slide a secondary mass (11) subjected to the action of a spring (12) positioned between the secondary mass (11) base and the external fins (13) on the sleeve (4).

Inside said cylindrical hollow (3), there is an outside sleeve (14) upon whose walls slides the secondary mass (11), the periphery of which is surrounded by a flexible expansion ring (15) in such a way that if, during the sliding motion of the secondary mass (11), it travels beyond the bottom edge (a) of the outside sleeve (14) with its ring (15), this latter will be released and thus prevent the secondary mass (11) from returning to its original position.

The inside sleeve (4) possesses a window through which protrudes a ball (16) that rests upon an angle shaped recess (17) formed in the inside walls of the secondary mass.

The top base of the secondary mass (11) is inserted into a round second recess (18) provided in a main gearwheel (19) subjected to the action of a torsion spring (20).

The main gearwheel (19) meshes with a lower pinion (21) that is coaxially attached to an upper pinion (22) which meshes with a rocker (23) that is coaxial with said main gearwheel (19).

Both the main gearwheel (19) as well as the rocker (23) are provided with round sector recesses (24), the radius of which is the same as that of a cylindrical shaped shell holder (25), which in turn is provided with a recess (26).

The shell holder (25) rotates upon its shaft (27) while subjected to the action of a torsion spring (28), and it possesses a hole (29) containing an instantaneous acting detonator (31), and a hole (30) containing a delayed action detonator (32).

Holes (29), (30) are located on the opposite side from the recess (26) on the shell holder (25), and their radius (r) is the same as the distance (1) between the axis (27) of the shell holder and the axis of the firing pin (33).

A communication capsule (34) is arranged on the body (1) coaxially to and below the detonators (31), (32) when they lie opposite the firing pin (33), and said capsule (34) transmits the action of said detonators (31), (32) to a multiplier block (35) which in turn transmits their action to the inside of the shell.

Screw (36) is provided with a beveled head (37). Screw (36) is also provided with a handle (38) for externally operating screw (36).

In a slot (39) on said screw (36), there is a keeper (40) which restrains the rotation of screw (36).

The shell holder (25) possesses a top pin (41) which may or may not abut against the bevelled head (37) according to how it has been fitted from the outside, and it possesses moreover a pin (42) which during its rotation, abuts with the main gearwheel (19).

Figure 4:
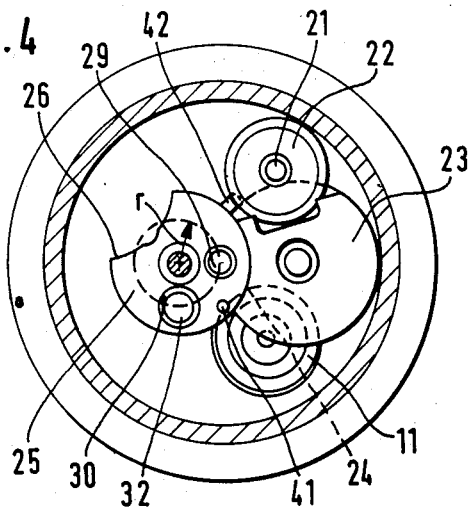
FIG. 4 is a section plan view upon FIG. 3 taken along line IV—IV.

The mode of operation is as described below:

For carrying, a pin is inserted into throat (43) of the mass (11), and so long as the secondary mass (11) is linked with the main gearwheel (19) as shown in FIGS. 1 and 4, the entire system is prevented from moving, and so the time fuse and shell are in a safe mode.

Once the shell is on the firing range, the pin in throat (43) is removed. Any accidental dropping could cause the secondary mass (11) to move, and this is prevented by the operation of ball (16) which is unable to move so long as the primary mass (5) does not do so. The difference in inertia between the primary mass (5) and the secondary mass (11) and their respective springs means that ball (16) only undergoes a relative displacement and consequent release when the acceleration forces, albiet strong, take place within a certain space of time; that is to say, when there is real firing and not just accidental dropping.

The motion of the primary mass (5) allows the ball (16) to become displaced, and the secondary mass (11) to be released, which in turn brings about the release of the main gearwheel (19) under the effect of its spring (20).

In order to prevent the secondary mass (11) from returning to its original position and becoming joined again to the main gearwheel (19) and thus detaining the action that has commenced, a hollow (3) is provided in the body (1) of an outer sleeve (14), in which the secondary mass (11) can slide, and about whose periphery is placed a flexible expansion ring (15) which expands when it releases the lower edge (a) of the outer sleeve (14) and thus creates a non-return for the secondary mass (11).

When the main gearwheel (19) is released, its motion is transmitted by means of the lower pinion (21) and the upper pinion (22) to a rocker arm (23), which delays for a preset time, the rotation of the main gearwheel (19) which means that there will be no percussion upon the detonators if the shell has not traveled over by a predetermined distance from the firing position.

Figure 2:
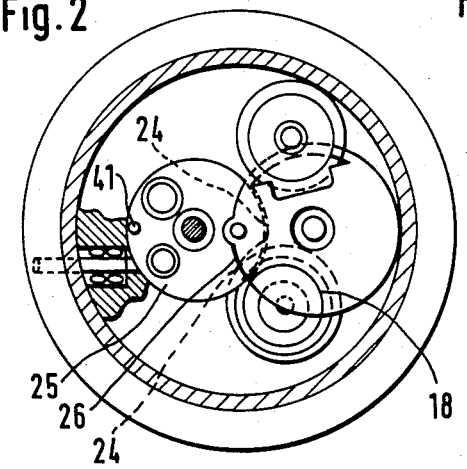
FIG. 2 is a section plan view upon FIG. 1 taken along line II—II.

The shell holder (25) is placed in the idle position and remains so until such time as it is released by the main gearwheel (19) when its recess (26) lies opposite the main gearwheel (19). (See FIGS. 1 and 2).

The main gearwheel (19) rotates, and in doing so, it reaches a position where its recess (24) lies opposite the recess (26) on the shell holder (25), which then allows this latter to rotate.

If it is desired to have the shell explode as soon as it touches anything solid, the bevelled head (37) under control from the handle (38) is set so as to allow pin (41) to pass, and until the lower pin (42) abuts with the main gearwheel (19), whereupon the detonator (31) will be positioned opposite the firing pin (33).

If what is desired is for the shell to explode some time after impact, handle (38) is moved so that when the shell holder (25) is rotated, the bevelled head (37) will not allow pin (41) to pass, so that the delay detonator (32) lies opposite the firing pin (33).

In the carrying position (See FIG. 1), the purpose of avoiding breakage of the pin (33) due to any accidental dropping is accomplished by means of a recess (45) in the shell holder (25).

I claim:

1. A mortar shell time fuse, said time fusing having a body and a head, said body having a hollow therein, said time fuse comprising:

(a) a primary mass positioned in said hollow, said primary mass having a needle-shaped head, a first return spring means positioned in said hollow and acting upon said primary mass;

(b) an inside sleeve positioned in said hollow, said primary mass slidably engaged inside said inside sleeve, said inside sleeve having an upper hold through which said needle-shaped head of said primary mass protrudes when said mortar shell is at rest, said inside sleeve having a side window therein;

(c) a secondary mass slidably engaging the outside of said inside sleeve, a second return spring means positioned in said hollow and acting upon said secondary means, said secondary mass having a slot therein, said slot alignable with said side window when the mortar shell is at rest;

(d) a ball member positioned in said side window and engagable with said slot and said primary mass when the mortar shell is at rest;

(e) a shell holder rotatably mounted on a shaft, said shaft mounted in said body, a first torsion spring means attached to said body and acting upon said shell holder; and (f) a gear train rotably mounted on said body, said gear train linked to said secondary mass when said mortar shell is at rest, said gear train having a rocking means for retarding said gear train and having a means for restraining said shell holder, a second torsion spring means attached to said body and acting upon said gear train such that when the mortar shell is fired said primary and secondary mass slide downward along said inside sleeve and release said rocking means which in turn releases said means for restraining said shell holder, thereby causing said first torsion spring means to act on said shell holder and rotate said shell holder such that a detonator port is aligned with a firing pin.

2. A mortar shell time fuse in full accordance with claim 1 wherein said shell holder is a cylinder, and said main gear train has a main gearwheel, said shell holder and said main gearwheel being positioned such that the distance between the axis of said shell holder rotation and the main gearwheel axis is less than the sum of the radii of the main gearwheel and shell holder and said shell holder and said main gearwheel being positioned such that when said mortar shell is at rest, non-recessed area of said shell holder lies opposite a recessed area on the main gearwheel.

3. A mortar shell time fuse in full accordance with claim 1 wherein the shell holder possesses two detonator ports.

4. A mortar shell time fuse in full accordance with claim 1 further comprising a pin attached to said shell holder which abuts against the main gearwheel during rotation of the shell holder, thereby imposing a limitation as to the shell holders turning angle in such a way that one of the shell holder ports lies opposite the firing pin.

5. A mortar shell time fuse in full accordance with claim 1 wherein the secondary mass comprises a groove therearound with a flexible expansion ring therein said ring being released once the secondary mass has travelled a predetermined distance downward along said inside sleeve.

6. A mortar shell time fuse in full accordance with claim 5 wherein the secondary mass comprises a throat therein suitable for inserting an externally operated pin therein as a safety means.

7. A mortar shell time fuse in full accordance with claim 1 wherein the gear train comprises:

(a) a main gearwheel, said gearwheel having a recess in the form of a circular sector on its lower face wherein the top of the secondary mass enters when the mortar shell is at rest;

(b) a bottom pinion which meshes with the main gearwheel; and (c) a top pinion which is coaxially attached to the bottom pinion.

8. A mortar shell time fuse in full accordance with claim 7 wherein said rocker means is coaxial with the main gearwheel and is driven by the top pinion.

9. A mortar shell time fuse in full accordance with claim 1 further comprising a bevel headed screw positioned in said head for determining the position of said detonator port.

10. A mortar shell time fuse in full accordance with claim 9 wherein the bevel headed screw is provided with a slot and further comprising a keeper in said slot for restricting the movement of said screw.

* * * * *